US006572520B2

(12) United States Patent
Blumle

(10) Patent No.: US 6,572,520 B2
(45) Date of Patent: Jun. 3, 2003

(54) APPARATUS FOR TRANSPORTING ENVELOPE BLANKS IN AN ENVELOPE MAKING MACHINE

(75) Inventor: Martin Blumle, Horhausen (DE)

(73) Assignee: Winkler + Dunnebler Aktiengesellschaft, Neuwied (DE)

( * ) Notice: Subject to any disclaimer, the term of this patent is extended or adjusted under 35 U.S.C. 154(b) by 33 days.

(21) Appl. No.: 09/860,129

(22) Filed: May 17, 2001

(65) Prior Publication Data

US 2001/0044368 A1 Nov. 22, 2001

(30) Foreign Application Priority Data

May 17, 2000 (DE) ..... 100 24 298

(51) Int. Cl.[7] ..... B31F 1/00; B31F 7/00

(52) U.S. Cl. ..... 493/450; 493/416; 493/418; 493/446; 271/197; 271/276

(58) Field of Search ..... 493/16, 186, 222, 493/231, 293, 446, 450, 418, 416; 198/581, 601, 604, 502.3, 502.4, 340; 271/276, 197, 196, 307, 311, 312

(56) References Cited

U.S. PATENT DOCUMENTS

| | | | | |
|---|---|---|---|---|
| 2,785,609 A | | 3/1957 | Billeb | 93/18 |
| 3,140,030 A | | 7/1964 | Stewart | 226/95 |
| 3,288,037 A | | 11/1966 | Burnett | 93/61 |
| 3,643,557 A | | 2/1972 | Hayes | 93/93 DP |
| 3,797,371 A | * | 3/1974 | Randle | 493/295 |
| 3,869,965 A | | 3/1975 | Howatt | 93/61 A |
| 3,982,472 A | | 9/1976 | Howatt | 93/61 A |
| 4,614,512 A | | 9/1986 | Capdeboscq | 493/441 |
| 4,651,984 A | * | 3/1987 | Emrich | 271/237 |
| 5,026,038 A | * | 6/1991 | Weller et al. | 271/3.12 |
| 5,046,710 A | * | 9/1991 | Vijuk | 270/37 |
| 5,087,313 A | * | 2/1992 | Duecker | 156/271 |
| 5,139,253 A | * | 8/1992 | Bohme et al. | 271/197 |
| 5,526,105 A | * | 6/1996 | Kenin et al. | 399/381 |
| 5,540,166 A | * | 7/1996 | Wiley | 112/475.03 |
| 5,551,551 A | * | 9/1996 | Crawford | 198/448 |
| 5,807,228 A | * | 9/1998 | Smithe et al. | 493/179 |

FOREIGN PATENT DOCUMENTS

| | | | |
|---|---|---|---|
| DE | 198 17 175 A1 | 3/1999 | B65H/29/66 |
| EP | 0 095 890 | 12/1983 | |
| EP | 0 502 687 B1 | 9/1992 | B31B/19/00 |
| GB | 1 578 119 | 11/1980 | |
| GB | 1 578 120 | 11/1980 | |

* cited by examiner

*Primary Examiner*—Rinaldi I. Rada
*Assistant Examiner*—Brian Nash
(74) *Attorney, Agent, or Firm*—Rosenthal & Osha L.L.P.

(57) ABSTRACT

An apparatus for transporting envelope blanks in an envelope making machine comprises at least one conveyor belt having a plurality of perforation holes therein, on which envelope blanks are transported through the machine in a conveyor plane. Beneath the conveyor belt is at least one suction chamber by means of which ambient air can be sucked through the perforation holes to retain blanks on the conveyor belt. At least one guide belt is provided on at least one side beside the conveyor belt in the direction of movement thereof. The conveyor belt and the guide belt are drivable so as to move synchronously in the direction of travel of the envelope blanks.

16 Claims, 5 Drawing Sheets

APPARATUS FOR TRANSPORTING ENVELOPE BLANKS IN AN ENVELOPE MAKING MACHINE

FIELD OF THE INVENTION

The present invention concerns an apparatus for transporting envelope blanks in an envelope making machine. In this specification the term envelopes is used to denote envelopes for containing letters and like documents and also shipping bags and the like.

BACKGROUND OF THE INVENTION

In a typical envelope making machine, envelope blanks or stampings are transported through various, successively arranged stations, for implementing various production steps therein. By way of example, the envelope blanks may typically pass through a printing station, a window glueing-in station for inserting and glueing a window in position in the envelope blank, a side flap folding station, a bottom flap folding station and a drying station.

One form of an apparatus for transporting envelope blanks in the side flap folding station of an envelope making machine can be found in EP 0 502 687 A1. In that case, the envelope blanks are transported by means of a plurality of endless belts or bands which are arranged in side-by-side relationship at a mutual spacing. Ambient air is drawn through the resulting intermediate spaces thereby defined between the endless belts, into a suction or vacuum chamber disposed beneath the plane of transportation movement defined by the endless belts. In that way, the envelope blanks are retained in a stable position on the endless belts so that they cannot be shifted or turned by the forces which occur in the side flap folding procedure. A disadvantage in this respect is that, when dealing with smaller formats of envelopes to be produced, the outer regions of the movable suction support formed by the endless belts and the spaces therebetween are not put to use so that ambient air is unnecessarily drawn in through the intermediate spaces between the endless belts. That results in unnecessary power consumption on the part of the suction blower used.

A further form of apparatus for transporting envelope blanks in a side flap folding station is to be found in U.S. Pat. No. 3,288,037. In that apparatus, the envelope blanks are conveyed through the side flap folding station on a single conveyor belt which has a plurality of perforation holes therethrough. Disposed beneath the conveyor belt is a suction chamber by means of which ambient air can be drawn through the perforation holes. In that way the envelope blanks are also retained on the conveyor belt in a stable position by means of the effect of suction air applied thereto. FIG. 1 of U.S. Pat. No. 3,288,037 to which reference may be made shows that the envelope blank or the envelope to be produced projects beyond the edges of the conveyor belt, being the lateral edges in the direction of movement of the conveyor belt. Therefore, the regions of the envelope blank which project beyond the edges of the conveyor belt are not supported by the conveyor belt itself, but by other support elements which are disposed beneath those regions. Unwanted frictional forces occur between the stationary support elements and the envelope blanks by virtue of the relative movement of the envelope blanks with respect to the support elements. Those frictional forces have a particularly detrimental effect in the production of what are known as side closure shipping bags which have a comparatively large side flap and a comparatively small side flap which are not folded over simultaneously but in succession. By virtue of the frictional forces which occur asymmetrically as a result, between the support elements and the regions of the envelope blanks which project beyond the conveyor belt, turning moments occur about the vertical axis of the envelope blanks and can undesirably tilt or turn the envelope blanks. Such turning moments are referred to herein as yawing moments. Unwanted frictional forces or yawing moments can also be produced in other processing stations of the envelope making machine.

SUMMARY OF THE INVENTION

An object of the present invention is to provide an apparatus for transporting envelope blanks in an envelope making machine, which makes optimum use of the suction power of the suction fan and which at the same time at least substantially contributes to preventing the occurrence of unwanted frictional forces and/or yawing moments at the envelope blanks.

Another object of the invention is to provide an apparatus for transporting envelope blanks through an envelope making machine, which affords greater versatility in terms of adaptability of the operating structure of the apparatus to varying envelope formats.

Yet another object of the present invention is to provide an apparatus for transporting envelope blanks through an envelope making machine, which is so designed as to make optimum use of a suction effect applied to envelope blanks by means of a suction chamber to hold them in position as they pass through the machine.

Still a further object of the invention is to provide an envelope making machine including an apparatus for transporting envelope blanks therethrough in a more efficient and more reliable fashion while being of a simplified operating structure.

In accordance with the principles of the present invention the foregoing and other objects are attained by an apparatus for transporting envelope blanks in an envelope making machine, comprising at least one conveyor belt having a plurality of perforation holes, for transporting thereon the envelope blanks in a direction of movement in a transport plane defined by the conveyor belt. At least one suction chamber is disposed beneath the conveyor belt, operable to draw ambient air through the perforation holes. Provided beside the conveyor belt at least one of the two sides thereof is at least one guide belt. The conveyor belt and the one or more guide belts are drivable in such a way that they move synchronously in the direction of movement of the blanks through the apparatus.

It will be noted in this respect that the suction chamber is of such an arrangement, configuration and dimensions that a suction action for holding the envelope blanks in place on the at least one conveyor belt is produced exclusively above the conveyor belt, while the space above the at least one guide belt does not have any suction action operable thereat to draw the envelope blanks on to the guide belt.

Further in accordance with the principles of the invention the foregoing and other objects are attained by an envelope making machine including an apparatus for transporting envelope blanks therethrough, comprising at least one conveyor belt having a plurality of perforation holes and operable to transport thereon the envelope blanks through the machine. At least one suction chamber is disposed beneath the conveyor belt, operable to produce a suction effect to draw ambient air through the perforation holes downwardly through the conveyor belt. At least one guide belt is disposed beside the conveyor belt on at least one of the two sides thereof. The conveyor belt and the at least one guide belt are driven in such a way that they move synchronously to convey envelope blanks through the machine.

As will be apparent from the description hereinafter of a preferred embodiment of the envelope blank-transporting apparatus, the apparatus affords the advantage that the width of the perforated conveyor belt can be designed to conform to the width of the smallest envelope format which is to be produced with the envelope making machine in which the apparatus of the invention is used. That ensures that no unnecessary ambient air is drawn in even through the perforation holes which are in the outer regions of the conveyor belt, and accordingly the suction power of the suction chamber and the suction fan producing the suction flow is not wasted. The apparatus according to the invention also involves a minimum amount of complication and expenditure in terms of changing envelope formats. In that respect, essentially only the respective tool elements of the respective station in the machine have to be displaced transversely with respect to the direction of movement of the envelope blanks through the apparatus. For example, in the case of a side flap folding station in an envelope making machine, the folding elements are moved closer together or are moved further away from each other, in order to adapt the folding station to differing formats.

In accordance with a preferred feature of the invention, it is possible to provide at least one or more guide belts on both sides of the conveyor belt. It is however also possible to arrange one or more such guide belts only on one side of the conveyor belt. That may be the case for example when, in a given part of the side flap folding station, a large side flap of a side closure shipping bag is folded while no processing or folding operation is carried out on the shipping bag in that part of the station, on the side where the small side flap is disposed.

Preferably, the conveyor belt and the at least one guide belt are driven by the same drive device. That is the best manner of ensuring that the conveyor belt and the guide belts are moved synchronously, that is to say at the same speed, in the passage direction through the apparatus. It is also possible in accordance with the invention however to provide a respective separate drive device for the conveyor belt and for the at least one guide belt, as long as they are suitably matched to each other in such a way that the conveyor and guide belts move synchronously relative to each other.

A stationary separating bar or rail can advantageously be provided between the conveyor belt and the at least one guide belt. The separating bar separates the conveyor belt from the guide belt or belts and in addition ensures that ambient air is not sucked in by way of the lateral edges of the conveyor belt.

In a preferred feature of the invention, a fault or incident detection sensor is disposed in the separating bar. The sensor may be an electromagnetic or optical sensor integrated into the separating bar. In that case for example a photodiode may be integrated into the separating bar, to receive optical signals constantly or at intervals of time from a photoemitter disposed above the transport plane. In fault-free operation of the envelope making machine the fault detection sensor records regular signal interruption times in optical transmission of the signals, which are caused by the envelope blanks passing therethrough and which are thus characteristic in respect of trouble-free operation. If however the sensor detects irregularities in the signal interruption times, it can signal for example to a central machine control system that the envelope making machine is suffering from an operational fault which is characterised by such irregularities.

A further advantage of the separating bar or bars is that, in the direction of movement of the envelope blanks through the apparatus, the bar or bars can be prolonged a little beyond a drive roller or shaft for the conveyor and guide belts which are in the form of endless belt members. That provides that the envelope blanks are reliably transferred to the next part in the same station or to the next station of the envelope making machine. Otherwise, the envelope blanks could remain clinging to the conveyor belt or the guide belts, for example due to a static charge, and as a consequence could undesirably follow those belts in their movement as they pass around the drive roller or shaft. The fact that the separating bar or bars is or are prolonged in that way means that the envelope blanks are guided by the bars in such a way as to be peeled off the belts as they move, thereby to ensure that the envelope blanks are not deflected out of their substantially straight path of movement through the apparatus.

In accordance with a further preferred feature of the invention, the apparatus may have two or more perforated conveyor belts. In order to ensure that such a construction does not suffer from a low level of efficiency at each of the plurality of conveyor belts, in terms of making use of the suction effect generated by the suction chamber, stationary sealing bars are arranged in the intermediate spaces between the conveyor belts. The sealing bars ensure that ambient air cannot be drawn through the intermediate spaces between the conveyor belts. If required, the sealing bars can also be prolonged in the direction of movement of the envelope blanks through the apparatus, in order to produce a peeling-off effect, in a similar manner to the above-described prolongation of the separating bars.

It is also possible for an electromagnetic or optical fault detection sensor as described above to be integrated into one or more of the sealing bars. It will be appreciated that the apparatus according to the invention can be used in any station which is usually provided in an envelope making machine. In particular, the apparatus can also operate as a pure transportation station defining a transport plane, above which no processing operations are implemented on the envelope blanks. Examples in regard to possible uses of the apparatus according to the invention are in a side flap folding station, a window glueing-in station or a drying station.

Further objects, features and advantages of the invention will be apparent from the description hereinafter of a preferred embodiment of the invention.

DESCRIPTION OF THE PREFERRED EMBODIMENT

Figure 1:
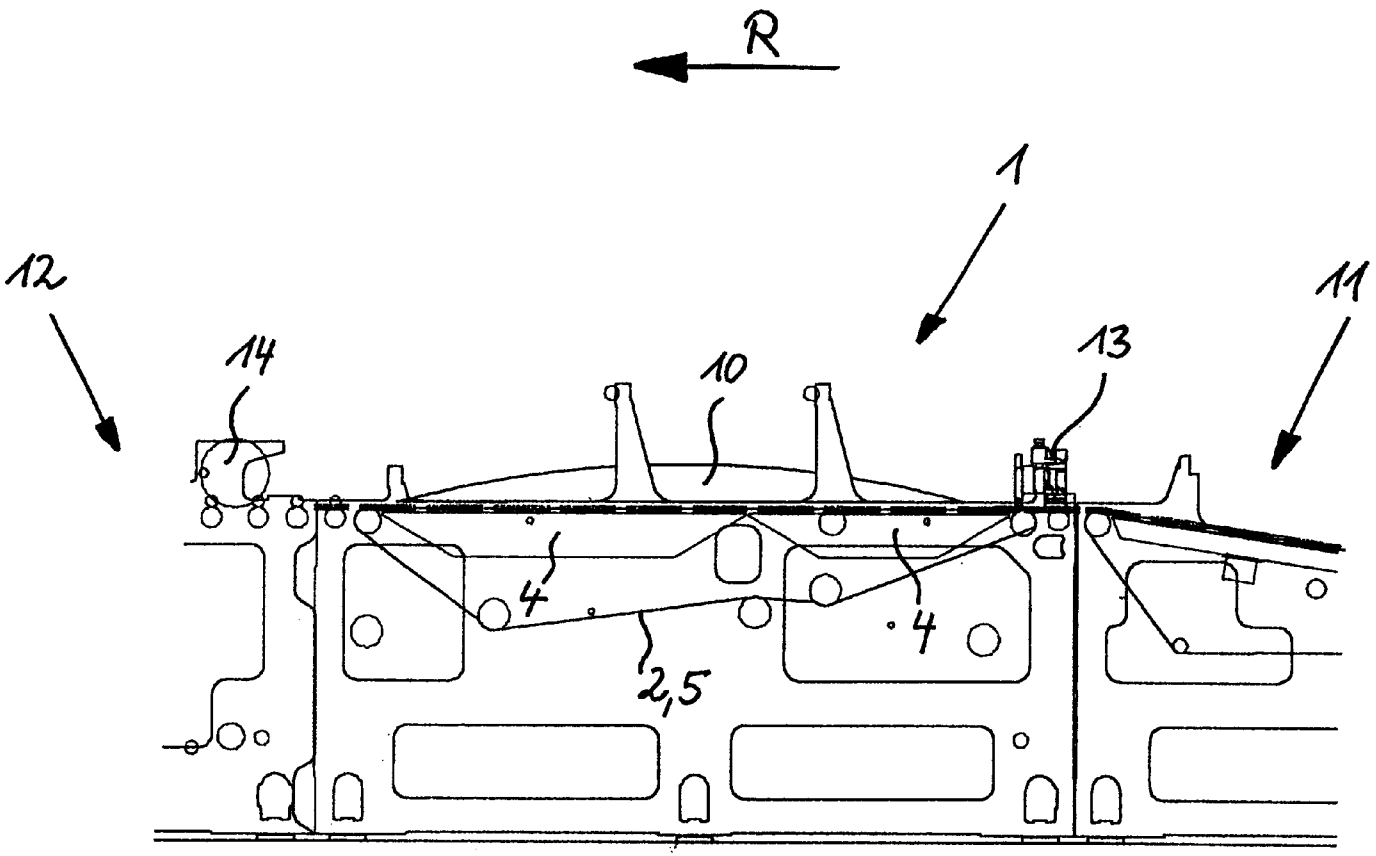
FIG. 1 is a side view of an apparatus according to the invention for transporting envelope blanks in a side flap folding station of an envelope making machine.

Referring firstly to FIG. 1 and the side view therein of part of an envelope making machine, reference numeral 1 denotes a side flap folding station of an envelope making machine. In this respect, as noted above, the term envelopes is used to denote envelopes for containing letters and like documents and also shipping bags and the like. The arrow indicated at R in FIG. 1 identifies the direction of movement of the envelope blanks through the envelope making machine.

Reference numeral 11 denotes a window glueing-in station which is disposed upstream of the side flap folding station 1, as can be seen in the right-hand part of FIG. 1. Downstream of the side flap folding station 1 in the direction R is a bottom flap folding station 12, as shown at the left-hand part of FIG. 1. The envelope making machine of which part is shown in FIG. 1 is designed for the production of despatch or shipping bags so that a side flap glueing device 13 can be seen immediately upstream of the side flap folding station 1 and a bottom flap glueing device 14 can be seen immediately downstream of the side flap folding station 1.

Figure 2:
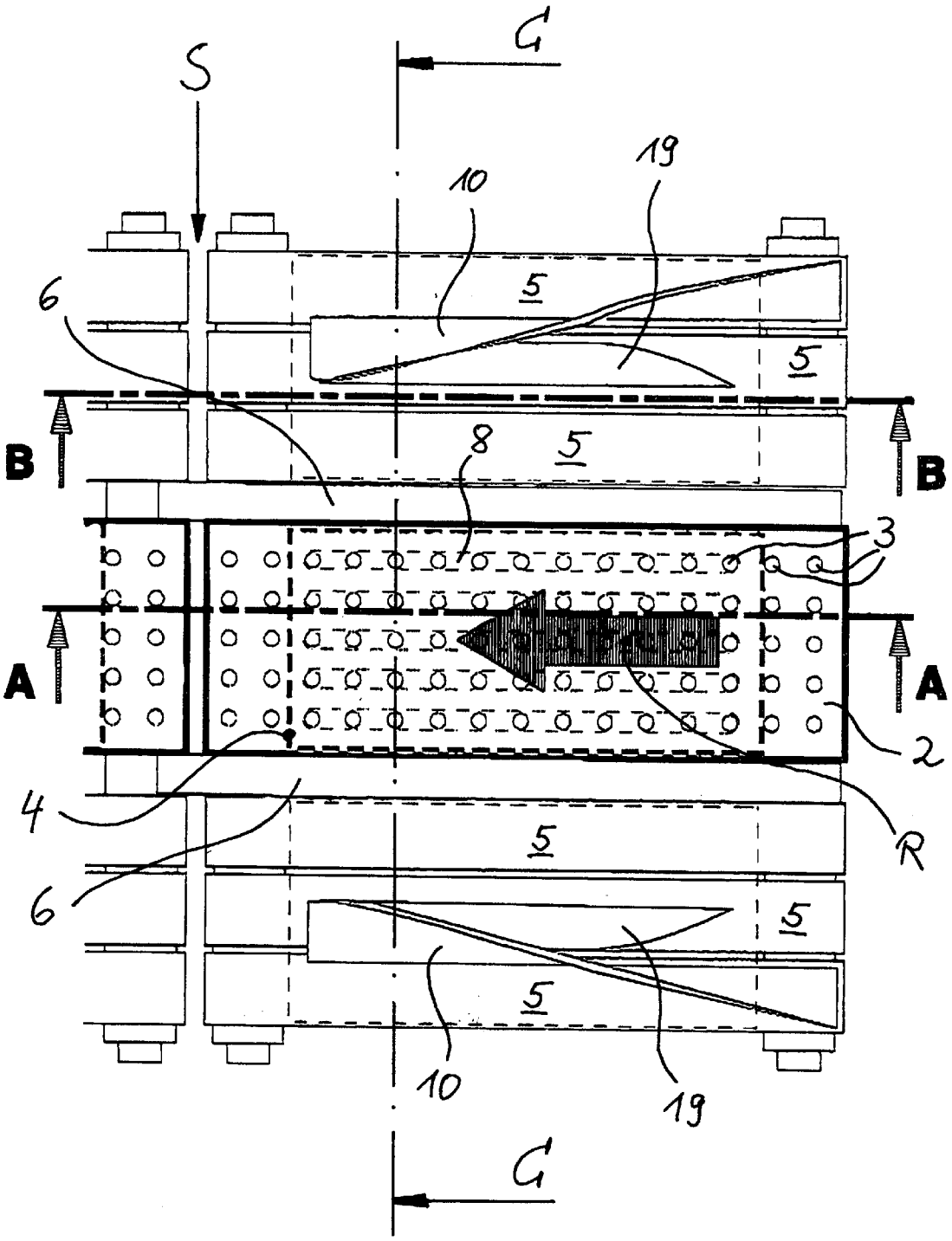
FIG. 2 is a diagrammatic plan view of an apparatus according to the invention for transporting envelope blanks in the side flap folding station of an envelope making machine.

FIG. 2 shows a diagrammatic plan view of a side flap folding station with an apparatus according to the invention for transporting the envelope blanks therethrough. FIG. 2 shows a conveyor belt 2 which is provided with a plurality of perforation holes 3 therethrough, the conveyor belt 2 being in the form of an endless belt or band, as can most clearly be seen from FIG. 3. The conveyor belt 2 passes around a drive roller indicated at 15 in FIG. 3 and three direction-changing guide rollers which are indicated at 16 in FIGS. 3 and 4 but which are not driven. The drive roller 15 rotates in the counter-clockwise direction in FIGS. 3 and 4 so that the load-bearing run of the conveyor belt 2 moves in the direction of travel R of the envelope blanks, that is to say towards the left in FIGS. 2 and 3.

As shown in FIG. 2, the perforation holes 3 are small circular holes. It is however also possible to envisage holes of a different geometry. In the illustrated embodiment, the conveyor belt 2 has five rows of perforation holes 3, wherein the individual perforation holes 3 of a respective row are uniformly spaced from each other and the rows are disposed in mutually juxtaposed relationship in such a way that the perforation holes 3 are each at the same level, as considered in the direction of movement R. It is also possible for the perforation holes of two adjacent rows to be arranged in such a way that the perforation holes 3 of one row are disposed beside the gaps between the perforation holes 3 in the adjacent row. Moreover, the geometry of the perforation holes 3 and the arrangement thereof in the conveyor belt 2 can be suitably adapted to the respective situation of use of the apparatus according to the invention.

Figure 3:
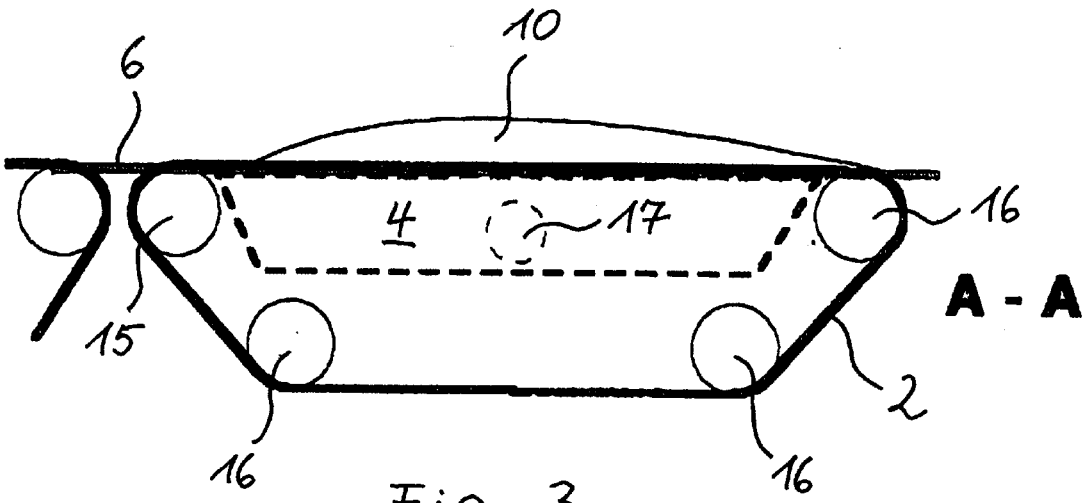
FIG. 3 is a view in section on line A—A in FIG. 2.

Looking still at FIG. 2, the thick broken lines therein indicate a suction chamber which is referenced 4 in FIG. 3. As can be clearly seen from FIG. 3, the suction chamber 4 is disposed beneath the load-bearing run of the conveyor belt 3 and can be communicated by way of a connecting portion 17 which can also be seen in FIG. 6 to a vacuum source or a suction blower. Ambient air can be drawn into the suction chamber 4 through the perforation holes 3, by means of the vacuum source or suction blower. As a result, a suction effect occurs at the top side of the load-bearing run of the conveyor belt 2. The suction action is operative to retain in a stable position on the conveyor belt 2 the envelope blanks which are supplied on to the conveyor belt 2 from the window glueing-in station 11.

Figure 4:
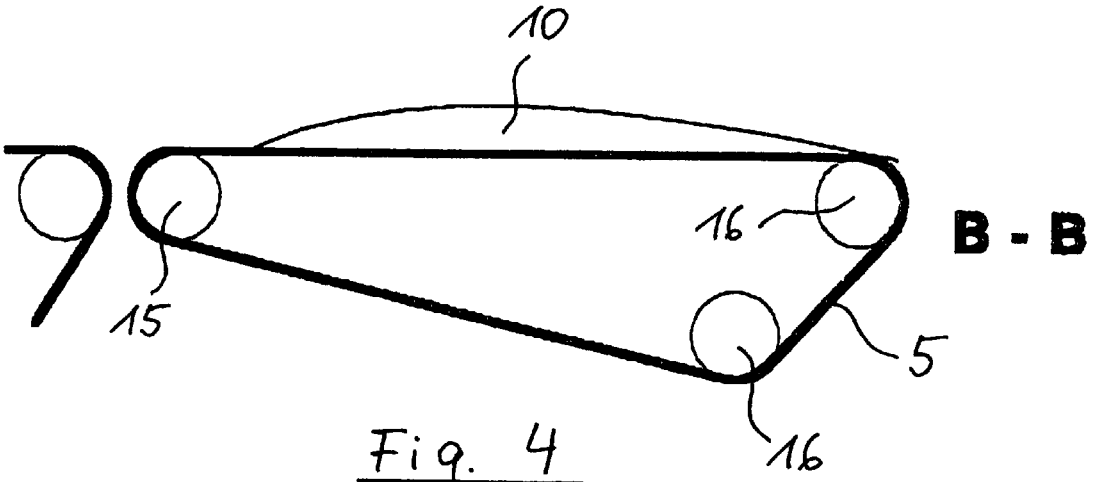
FIG. 4 is a view in section on line B—B in FIG. 2.

As viewed in FIG. 2, disposed above and below the perforated conveyor belt 2 are three guide belts indicated at 5, so that there are three guide belts 5 at each of the two sides of the conveyor belt 2. As shown in FIG. 4, the guide belts 5 are also in the form of endless belts or bands and rotate about the same drive roller 15 and two of the same direction-changing guide rollers 16, as the conveyor belt 2. As can be seen from FIG. 4, no suction chamber is disposed beneath the load-bearing runs of the guide belts 5 so that no suction effect is produced above the guide belts 5, for retaining the envelope blanks thereon.

Figure 6:
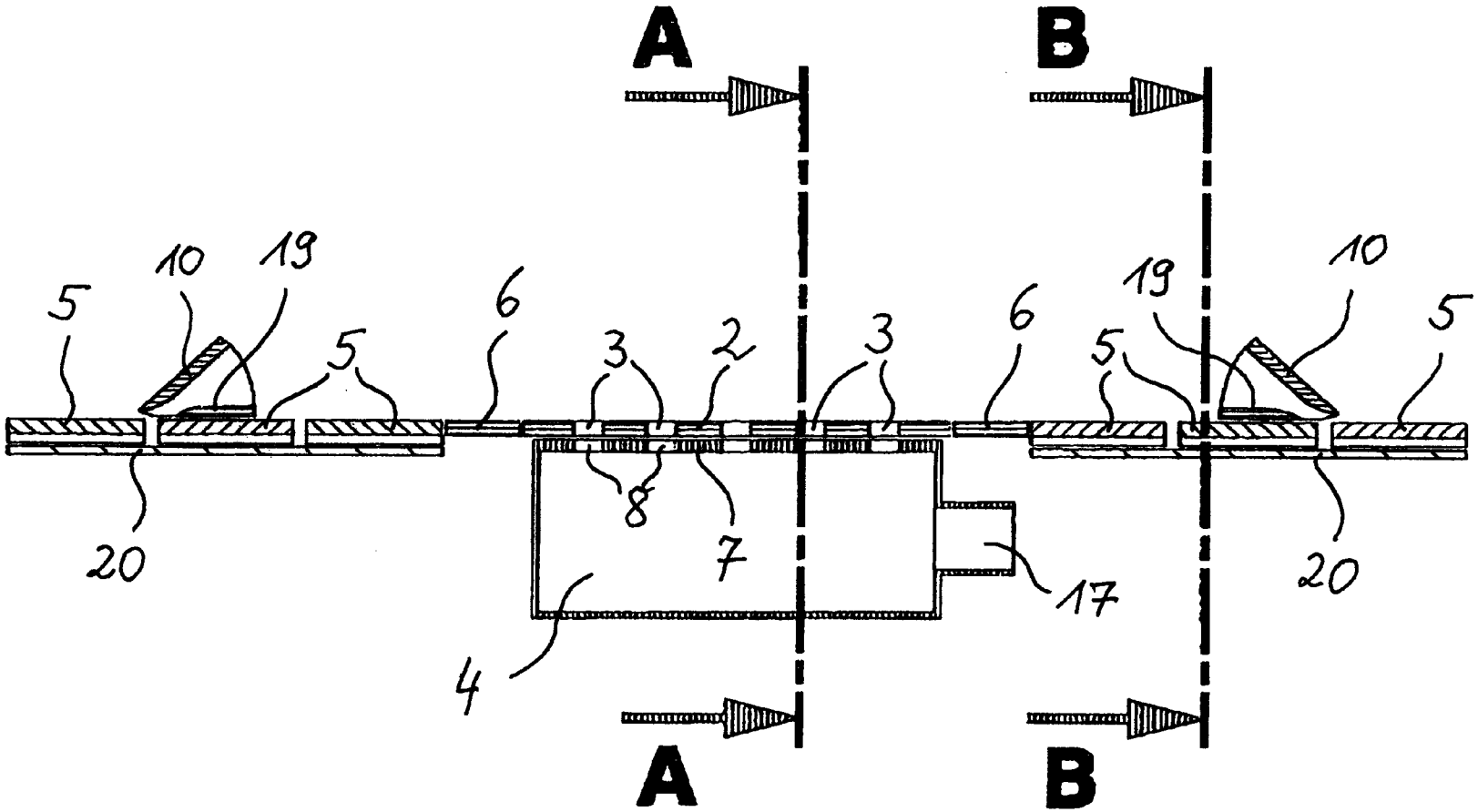
FIG. 6 is a view in section taken on line C—C in FIG. 2.

As can best be seen from FIGS. 2 and 6, the transportation surface in the illustrated embodiment is formed by a total of three regions which differ from each other in terms of their retaining effect on the envelope blanks supported thereon. More specifically, the first region which is the central region is formed by the conveyor belt 2 which is accordingly disposed at the center of the transportation surface, so that the envelope blanks carried thereon are subjected to a suction effect and are thereby reliably held in position on the conveyor belt 2. The second and third regions which form respective lateral regions on each side of the conveyor belt 2 are formed by the guide belts 5 which do not have any suction effect and which, as indicated above, are arranged symmetrically in the direction of movement R beside the conveyor belt 2.

The width of the conveyor belt 2 can be such that, even when the smallest envelope format is being processed in the envelope making machine, the two outermost rows of perforation holes 3 in the conveyor belt 2 are still covered by the respective envelope blank and thus contribute to the effect of retaining the envelope blanks on the conveyor belt 2.

As shown in FIGS. 2 and 6, provided on both sides of the conveyor belt 2 above the guide belts 5 is a respective folding device which includes a folding plow member 10 and a folding blade 19, for folding the side flaps of an envelope. As, in contrast to the side flaps of a shipping bag, the side flaps of an envelope for a letter or document do not rest on each other, the two folding devices are at the same level in the direction of movement R. When folding a side flap, the folding plow member 10 applies a force acting in the direction of view of FIG. 2, on the corresponding region of the envelope blank. That force results in a reaction force of equal magnitude, in respect of the guide belts 5 under the outer regions of the envelope blank, on the envelope blank itself. As in accordance with the invention that reaction force is no longer applied by a support which is stationary in space, that is to say, relative to which the envelope blank is moving, this apparatus configuration no longer involves the production of unwanted frictional forces which could act on the envelope blank in opposite relationship to the direction of movement R. In particular, in the case of side flap folding procedures which take place asymmetrically, there are no longer any yawing moments which could tilt or twist the envelope blank in the transport plane.

Figure 7:
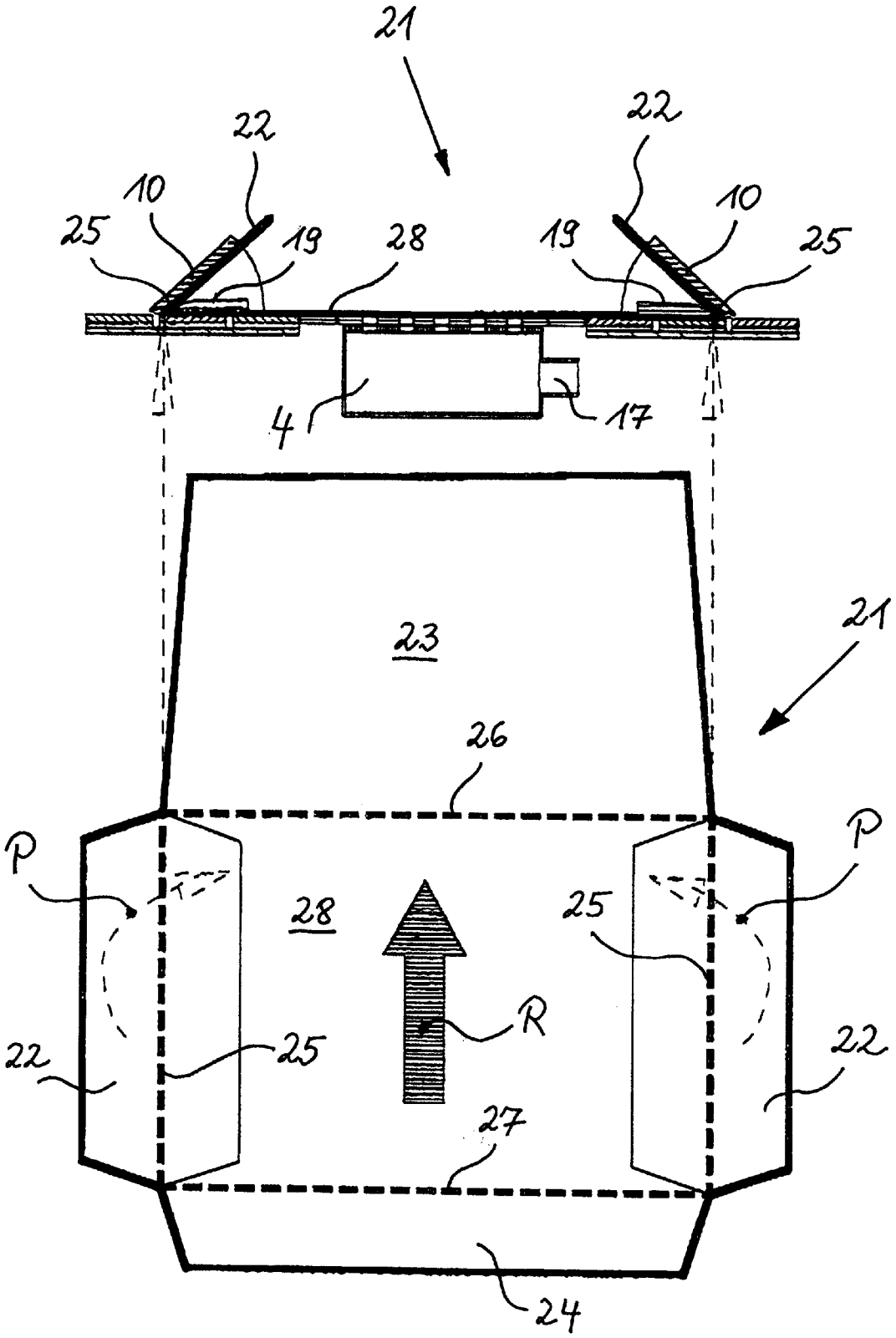
FIG. 7 shows the section C—C in FIG. 6 on a reduced scale, additionally showing an envelope blank during a folding operation and an enlarged envelope blank in the non-folded condition.

Reference will now be made to FIG. 7 and more particularly the upper part thereof, showing an envelope blank 21 during a side flap folding operation thereon. The lower part of FIG. 7 shows the envelope blank 21 in the non-folded condition. The envelope blank 21 shown here is used to produce an envelope for a letter or like document, in which the side flaps 22 do not overlap each other.

The envelope blank 21 moves with the bottom flap 23 leading, through the side flap folding station, as can be seen from the arrow R illustrating the direction of movement of the envelope blank in FIG. 7. The closure flap 24 of the envelope blank 21, which trails in the direction of movement R, is substantially smaller than the bottom flap 23. Before the operations of folding the side flaps 22, the bottom flap 23 and the closure flap 24, the envelope blank 21 is provided with side flap pre-fold lines 25, a bottom flap pre-fold line 26 and a closure flap pre-fold line 27. The paper of the envelope blank 21 is thinned or weakened along the lines 25, 26 and 27 so that the pre-fold lines operate as desired-fold lines for defining the locations at which the folds are to be produced, in order thereby to facilitate subsequent folding of the flaps in question.

The upper part of FIG. 7 shows the cross-sectional geometry adopted by the envelope blank 21 during the side flap folding operation, at the location of the section indicated at C—C in FIG. 2. The two side flaps 22 have already been folded inwardly through about 135° from the transport plane in a direction towards the front wall 28 of the envelope blank 21, as indicated by the arrows P in the lower part of FIG. 7. During the folding movement the side flap pre-fold lines 25 move in the direction R along the folding edges of the folding blade 19 so that the folding blade edges hold the front wall 28 completely in the transport plane and satisfactory rotation or folding of the side flaps 22 about the pivot or folding axes which are predetermined by the side flap pre-fold lines 25 is thereby guaranteed.

As shown in FIG. 6, the upper suction chamber wall 7 of the suction chamber 4 forms the running surface of the perforated conveyor belt 2 against which therefore the underneath surface of the conveyor belt 2 runs. That running surface prevents the conveyor belt 2 from sagging downwardly under the effect of the suction force applied thereto. As shown in FIG. 2, the openings in the upper suction chamber wall 2 are in the form of slots diagrammatically indicated at 8, which extend in the direction R substantially over the entire length of the suction chamber 4. The rows of perforation holes 3 are arranged in the conveyor belt 2 in such a way that the perforation holes 3 of one row, during the movement thereof over the upper suction chamber wall 7, completely align with the longitudinal slots 8, as can be clearly seen from FIGS. 2 and 6. When the conveyor belt 2 used is in the form of a flat belt, that ensures that the ambient air can be drawn by the suction effect into the suction chamber 4 through the perforation holes 3 and the longitudinal slots 8, without any problem.

The geometry of the openings in the upper suction chamber wall 7 can be adapted to the requirements involved in any particular situation, as needed. For example it is possible for the openings to be in the form of circular holes or slots which are arranged in succession in the direction of movement R.

Figure 5:
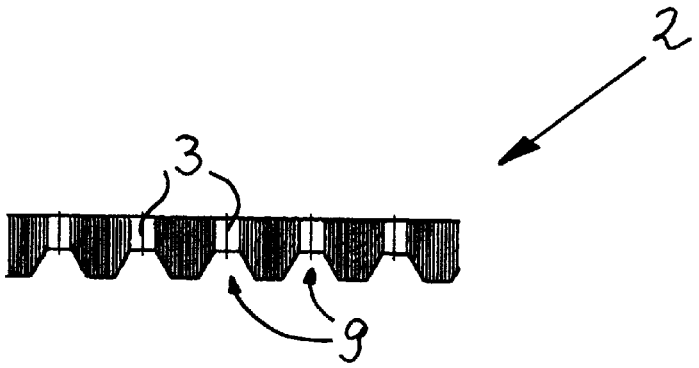
FIG. 5 is a view in longitudinal section through part of a conveyor belt in the form of a toothed belt.

Instead of the conveyor belt 2 being in the form of a flat belt as shown in FIGS. 2 and 6, the conveyor belt 2 can be in the form of a toothed belt as can best be seen from the part thereof shown in FIG. 5. In this case, the perforation holes 3 can be provided not only in an aligned relationship with the slots 8 but also in a non-aligned arrangement if the perforation holes 3 respectively open into the gaps 9 between the teeth of the toothed belt. With such an arrangement, the ambient air which is sucked in by the effect of the suction chamber 4 firstly flows downwardly into the perforation holes 3, then a short distance horizontally through the gaps 9 between the teeth of the toothed belt, and then once again downwardly through the openings such as slots 8 into the suction chamber 4. In other words, in this case the flow path of the ambient air is substantially S-shaped.

FIGS. 2, 3 and 6 also show the stationary separating bars 6 which are disposed between the conveyor belt 2 and the guide belts 5. The bars 6 are of a comparatively flat rectangular cross-section and are disposed substantially flush with the surface of the conveyor belt 2 and the guide belts 5 in the transport plane defined thereby. If required they can also be arranged to be a little below that transport plane. In relation to the conveyor belt 2 and/or the guide belts 5, the bars 6 form a comparatively small proportion of the total surface area of the transport plane defined by the conveyor and guide belts 2, 5.

FIG. 6 also shows two support plates which are identified by reference numeral 20 and along the surface of which move the guide belts 5 which in this embodiment are in the form of toothed belts. The support plates 20 prevent sag of the guide belts 5 under the effect of forces acting downwardly in FIG. 6, which can occur during a side flap folding operation. The support plates 20 therefore ensure that the load-bearing runs of the guide belts 5 as well as that of the conveyor belt 2 always run in the transport plane.

It will be seen from FIGS. 2 and 3 that the separating bars in the illustrated embodiment are prolonged in the direction of movement R beyond the drive roller 15 or the drive shaft thereof. As a result, the bars 6 project by a short distance into the region of the direction-changing guide rollers of the belts of the next following station which is to be seen at the left-hand edge part of FIGS. 2 and 3. That prolongation of the separating bars provides what can be referred to as a peel-off guidance effect for the envelope blanks which are to be transferred to the next downstream station, insofar as the separating bars with their prolongation portion peel the envelope blanks off the conveyor belt 2 and the guide belts 5. This therefore ensures that the envelope blanks do not remain clinging to the belts of the preceding station and for example do not pass into the gap between the stations which is identified by reference S in FIG. 2.

The or each separating bar may include a for example electromagnetic or optical fault or incident detection sensor which can be suitably integrated into the respective separating bar, to detect whether the apparatus is operating satisfactorily or whether a fault has occurred. Where the apparatus further has a plurality of conveyor belts 5, with a respective stationary sealing bar between each two conveyor belts to ensure that no ambient air is sucked into the suction chambers beneath the conveyor belts through the intermediate spaces between the conveyor belts, the or each sealing bar may also include a fault or incident detection sensor for a similar purpose.

It will be seen from the foregoing description that the apparatus for transporting envelope blanks in an envelope making machine provides for making optimum use of the suction effect of a vacuum source or suction blower, while at the same time contributing to preventing the occurrence of unwanted frictional forces or yawing moments at the envelope blanks. The conveyor belt and the at least one guide belt are drivable synchronously in the direction of travel of the envelope blanks, which is implemented in the illustrated embodiment by virtue of those belts being passed around and driven by the same drive roller and guide rollers.

It will be appreciated that the above-described conveyor apparatus and envelope making machine have been set forth solely by way of example and illustration of the principles of the invention and that various modifications and alterations may be made therein without thereby departing from the spirit and scope of the invention.

What is claimed is:

1. Apparatus for transporting envelope blanks in an envelope making machine comprising:

at least one conveyer belt having a plurality of perforation holes for transporting thereon the envelope blanks in a passage direction in a transport plane, at least one suction chamber beneath the conveyer belt and operable to suck ambient air through the perforation holes, at least one guide belt beside the conveyor belt on at least one of the two sides thereof in the passage direction, means for driving the conveyor belt and the at least one guide belt to move synchronously in the passage direction, and a stationary separating bar between the conveyor belt and the guide belt, said conveyor belt and said guide belt being arranged in said transport plane and said stationary separating bar being arranged in or a little below said transport plane.

2. Apparatus as set forth in claim 1 and including first, second and third guide belts on at least one of the two sides of the conveyor belt.

3. Apparatus as set forth in claim 1 including a fault detection sensor integrated into the separating bar.

4. Apparatus as set forth in claim 1 wherein the suction chamber comprises an upper suction chamber wall having a surface along which said conveyor belt is movable, said upper suction chamber wall having openings for suction intake of ambient air into the suction chamber.

5. Apparatus as set forth in claim 4 wherein said perforation holes are so arranged that they are aligned at least at times with said openings during the movement of the conveyor belt over the upper suction chamber wall.

6. Apparatus as set forth in claim 4 wherein the conveyor belt is a toothed belt having teeth and intermediate spaces between the teeth, and wherein the perforation holes respectively open into a said intermediate space and are so arranged that they are at least particularly out of alignment with the openings in the upper suction chamber wall during the movement of the conveyor belt over the upper suction chamber wall.

7. Apparatus as set forth in claim 4 wherein the suction chamber is an elongate chamber in said passage direction and the openings in the upper suction chamber wall are formed by slots extending substantially over the entire length of the suction chamber.

8. Apparatus as set forth in claim 4 wherein the openings in the upper suction chamber wall are formed by elongate holes arranged in succession in said passage direction and in a plurality of rows in mutually juxtaposed relationship.

9. Apparatus as set forth in claim 1 and including a plurality of said conveyor belts, and a respective stationary sealing bar between each two conveyor belts, the arrangement being such that no ambient air can be sucked into the suction chamber through spaces between the conveyor belts.

10. Apparatus as set forth in claim 9 and further including a fault detection sensor integrated into the sealing bar.

11. Apparatus as set forth in claim 1 which is integrated into a side flap folding station of an envelope making machine, wherein arranged above said transport plane is at least one folding device for folding side flaps of the envelope blanks.

12. Apparatus as set forth in claim 11 wherein said folding device is arranged above the at least one guide belt.

13. Apparatus as set forth in claim 1 which is integrated into a window glueing-in station of an envelope making machine, in which station at least one envelope window is glued into an envelope blank.

14. Apparatus as set forth in claim 1 which is integrated into a drying station of an envelope making machine, in which adhesive applied to the envelope blanks is dried.

15. Apparatus as set forth in claim 1 which is integrated into a drying station of an envelope making machine, in which gum applied to the envelope blanks is dried.

16. In an envelope making machine an apparatus for transporting envelope blanks in an envelope making machine comprising:

at least one conveyer belt having a plurality of perforation holes for transporting thereon the envelope blanks in a passage direction in a transport plane, at least one suction chamber beneath the conveyer belt and operable to draw ambient air through the perforation holes, at least one guide belt on at least one side of the conveyor belt, means for driving the conveyor belt and the guide belt for movement thereof synchronously in the passage direction, and a stationary separating bar between the conveyor belt and the guide belt, said conveyor belt and said guide belt being arranged in said transport plane and said stationary separating bar being arranged in or a little below said transport plane.

* * * * *

UNITED STATES PATENT AND TRADEMARK OFFICE

CERTIFICATE OF CORRECTION

PATENT NO. : 6,572,520 B2
APPLICATION NO. : 09/860129
DATED : June 3, 2003
INVENTOR(S) : Martin Blumle It is certified that error appears in the above-identified patent and that said Letters Patent is hereby corrected as shown below:

On the front cover of the patent under Section 30, Foreign Application Priority Data, please insert --.7-- after "100 24 298"

Signed and Sealed this

First Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,572,520 B2
APPLICATION NO. : 09/860129
DATED : June 3, 2003
INVENTOR(S) : Martin Blumle It is certified that error appears in the above-identified patent and that said Letters Patent is hereby corrected as shown below:

On the front cover of the patent under Section 73, Assignee, please replace

"Winkler + Dunnebler" with --Winkler + Dunnebier--.

Signed and Sealed this

Twentieth Day of May, 2008

JON W. DUDAS
*Director of the United States Patent and Trademark Office*